United States Patent [19]

Yagi

[11] Patent Number: 5,041,350

[45] Date of Patent: Aug. 20, 1991

[54] ELECTROPHOTOGRAPHIC PHOTORECEPTOR WITH INORGANIC COMPOUND IN CHARGE TRANSPORT LAYER

[75] Inventor: Shigeru Yagi, Kanagawa, Japan

[73] Assignee: Fuji Xerox Co., Ltd., Tokyo, Japan

[21] Appl. No.: 393,952

[22] Filed: Aug. 15, 1989

[30] Foreign Application Priority Data

Aug. 17, 1988 [JP] Japan ..... 63-203235

[51] Int. Cl.[5] ..... G03G 5/047

[52] U.S. Cl. ..... 430/58; 430/60; 430/66

[58] Field of Search ..... 430/60, 63, 66, 58

[56] References Cited

U.S. PATENT DOCUMENTS 4,702,980 10/1987 Matsuura et al. ..... 430/63

FOREIGN PATENT DOCUMENTS

| | | | |
|---|---|---|---|
| 59-28162 | 2/1984 | Japan | 430/60 |
| 59-46651 | 3/1984 | Japan | 430/66 |
| 62-151859 | 7/1987 | Japan | 430/63 |
| 63-63051 | 3/1988 | Japan | 430/58 |
| 63-31261 | 12/1988 | Japan | 430/60 |
| 1-156756 | 6/1989 | Japan | 430/58 |

*Primary Examiner*—Roland Martin

*Attorney, Agent, or Firm*—Finnegan, Henderson, Farabow, Garrett and Dunner

[57] ABSTRACT

An electrophotographic photoreceptor comprising at least a substrate, an electrical charge generating layer, and an electrical charge transporting layer, wherein the electrical charge transporting layer comprises a material selected from the group consisting of an oxide, carbide, and nitride of aluminum, and a mixture of two or more of the foregoing, the selected material being combined with a transition metal element.

19 Claims, 1 Drawing Sheet

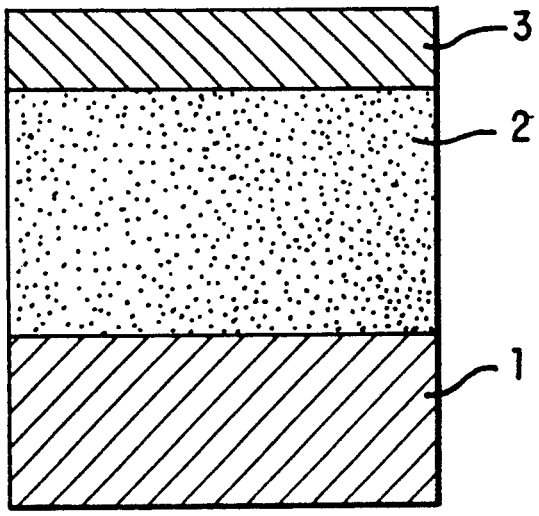

ELECTROPHOTOGRAPHIC PHOTORECEPTOR WITH INORGANIC COMPOUND IN CHARGE TRANSPORT LAYER

BACKGROUND OF THE INVENTION

1. Field of The Invention

The present invention relates to an electrophotographic photoreceptor and, more particularly, to an electrical charge transporting layer of an electrophotographic photoreceptor having function-separation-type photoreceptor.

2. Description of the Related Art

In so-called function separation type photoreceptor the photosensitive region of an electrophotographic photoreceptor is separated into an electrical charge generating layer which generates electrical charge carriers by means of irradiation of light on a photosensitive layer, and an electrical charge transporting layer, which efficiently transports the electrical charge carriers which have been generated at the charge generating layer. Both organic and inorganic materials have so far been used as the electrical charge transporting layer. The organic material has been made, for example, by dispersing or dissolving a polymeric compound material such as polyvinylcarbazol, or a low-molecular-weight compound material such as pyrazoline or a triphenylamine, in a polymeric binding resin such as a polycarbonate. The inorganic material has been made, for example, of such substances as represented by a chalcogenide compound like selenium telluride or the like.

However, the life of an electrophotographic photoreceptor using such an electric charge transporting material is limited to thousands to tens of thousand of times of copying because of its unstable electrical repeatability (i.e., charge acceptance, dark decay, residual potential, and the like), and because of its tendency to peel and become scratched within the copying machine due to insufficient mechanical strength (i.e., hardness, adhesivity, and the like). Therefore, it is difficult to form an image which is stably repeatable over a long period of time. But, when a surface layer, a adhesive layer, or the like is provided to improve these weaknesses, the composition of the electrophotographic photoreceptor becomes complex and the generation of defects during the manufacturing process of the electrophotographic photoreceptor increases.

Further, an electrophotographic photoreceptor having a conventional organic electrical charge transporting material has insufficient electrical charge mobility. This can result in an electrophotographic photoreceptor which has unsatisfactory decay of the charge potential in low temperature environments and is unsuitable for high-speed copying operations.

Moreover, an electrophotographic photoreceptor having a conventional organic electrical charge transporting material has insufficient resistance to heat or light and suffers from crystallization or decomposition of low-molecular-weight materials. As a result, it is necessary to regulate the conditions or the environment in which the electrophotographic photoreceptor is to be used or kept.

Still further, in a conventional electrophotographic photoreceptor adopting a function separated type in which a charge transporting layer constitutes a part of the photo conductive layer, the charge transporting layer is generally thin. Therefore, absorption of light in the vicinity of the absorption region by the electrical charge generating layers is diminished and the quantity of light transmitted through the charge generating layers is increased. As a result, generation of interference fringes due to multiple reflections of the reflected light from the substrate are inevitable. This is especially true in printers utilizing infrared laser.

SUMMARY OF THE INVENTION

It is an object of the present invention to provide a highly durable electrophotographic photoreceptor having a novel electrical charge transporting layer with excellent adhesion, mechanical strength, hardness, and few defects.

It is another object of the present invention to provide an electrophotographic photoreceptor having high sensitivity and panchromaticity, high charge acceptance with small dark decay and small residual potential after exposure.

It is still another object of the present invention to provide an electrophotographic photoreceptor having high picture quality by preventing the generation of interference fringes in laser printers utilizing coherent light of an infrared semiconductor laser, or the like, as a light source.

The applicants of the present invention discovered previously that aluminum oxides possess electrical charge transporting functions (U.S. Ser. No. 07/348,181). As a result of further vigorous study, the applicants found that oxides, carbides, and nitrides of aluminum containing transition-metal elements possess still better electrical charge mobility. In addition, it was found that electrophotographic photoreceptor using these electric charge transporting materials possess physical, mechanical, and optical properties far superior to electrophotographic photoreceptor using conventional electrical charge transporting materials. These findings led to the culmination of the present invention.

The electrophotographic photoreceptor of the present invention is characterized by at least a substrate, an electrical charge transporting layer and an electrical charge generating layer. The electrical charge transporting layer is formed by an oxide, carbide, or nitride of aluminum, or a mixture of two or more of these substances, in addition to a transition metal. Advantageously, this electrical charge transporting layer has high adhesivity, high mechanical strength and hardness, and few defects.

In addition, the electrophotographic photoreceptor obtained by the present invention exhibits high durability, high photosensitivity , enhanced panchromaticity, high charge acceptance, and low dark decay, as well as low residual potential after exposure.

Further, the electrophotographic photoreceptor of the present invention is applicable to devices utilizing a light source of coherent light such as an infrared semiconductor laser. It is therefore possible to obtain a high quality picture without generation of interference fringes.

BRIEF DESCRIPTION OF THE DRAWINGS

The manner by which the above objects and other are attained will be fully apparent from the following detailed description when it is considered in view of the drawings, wherein:

FIG. 1 is a schematic sectional diagram illustrating a first embodiment of the electrophotographic photoreceptor of the present invention;

FIG. 2 is a schematic sectional diagram illustrating a second embodiment of the electrophotographic photoreceptor of the present invention; and FIG. 3 is a schematic sectional diagram illustrating a third embodiment of the electrophotographic photoreceptor.

DETAILED DESCRIPTION OF THE INVENTION

FIGS. 1, 2, and 3 illustrate three embodiments of the present invention in which like reference numbers designate like or corresponding parts throughout the several drawings.

In FIG. 1, a charge transporting layer 2 and a charge generating layer 3 are formed in this order on a substrate 1.

In FIG. 2, a charge generating layer 3 and a charge transporting layer 2 are formed in this order on a substrate 1.

In FIG. 3, an intermediate layer 4 such as a charge blocking layer, a charge transporting layer 2, a charge generating layer 3 and a surface protective layer 5 are formed in this order on a substrate 1.

With respect to the three embodiments illustrated in FIGS. 1, 2, and 3, the charge transporting layer of the present invention may be placed on the substrate side with respect to the charge generating layer or on the side opposite to the substrate with respect to the charge generating layer.

In the present invention, either an electrically conductive or insulating substrate may be used. A material such as aluminum, stainless steel, nickel, chrome, or the like, or one of their alloy may be used as the conductive substrate. Conversely, a polymeric film or polyester sheet of polyethylene, polycarbonate, polystyrene, polyamide, polyimide, or the like, or a glass, or a ceramic, or the like, may be used as the insulating substrate. When using an insulating substrate, it is necessary to perform condition processing at least to the insulating substrate's surface that is in contact with another layer. The condition processing may be performed by means of deposition, sputtering, ion plating, or other method, of gold, copper or the like, or one of the above-mentioned metals. During use, irradiation of light may be applied to either the substrate side of the electrophotographic photoreceptor or to the side opposite the substrate. In the case of applying irradiation to the substrate side with the use of an above-mentioned metal, the substrate thickness should be such that the light irradiating it are allowed to pass through. In addition, use may be made of a transparent conductive film such as ITO.

In the present invention, the transition metal element to be included in the charge transporting layer may be made of a 3d, 4d, or 5d transition metal element. In the case of including a 3d, transition metal element such as Sc, Ti, V, Cr, Mn, Fe, Co, Ni, or Cu, which has a relatively small d electron orbital radius distributed relatively close to the nucleus and a satisfactory directivity of the orbital, in a compound of aluminum, overlapping of atomic orbitals between the transition metal elements can be made small and localized. This is desirable because of the resulting ease in controlling dark conductivity and charge mobility.

The charge transporting layer of the present invention is mainly comprised of an oxide, carbide, or nitride of aluminum, or a mixture of two or more of these. The charge transporting layer may be synthesized by means of a vapor phase deposition method such as CVD, plasma CVD, PVD (physical vapor deposition) such as ion plating, by means of a liquid phase deposition method such as the sol-gel method, or by means of a solid phase-liquid phase reaction method such as anode oxidation.

Incorporation of a transition metal element into the charge transporting layer may be accomplished simultaneously with an above mentioned deposition process by the use of mixed raw materials, or separately by the decomposition of the material on the substrate. Alternatively, incorporation of a transition metal element may be accomplished by a method such as ion implantation, dipping, or impregnation after the formation of an aluminum compound mentioned earlier.

The ratio of oxygen or nitrogen to aluminum in the charge transporting layer should be in the range of 0.1–2.0, preferably 0.2–1.5 in atomic ratio. When the ratio amount of oxygen or nitrogen is less than 0.1, the resistance becomes too low and sufficient retention of charge cannot be secured.

The ratio of carbon to aluminum in the charge transporting layer should be in the range of 0.05–0.7, preferably in the range of 0.1–0.7 in atomic ratio. When the ratio amount of carbon is less than 0.05, the resistance becomes too low and sufficient charge retention cannot be secured.

The content of transition metal element in the charge transporting layer should be in the range of 0.01–30% by atom, preferably 1-20% by atom. When it is less by atom, preferably 1–20% by atom. When it is less than 0.01% by atom, the layer's transporting function is not effective, and when it exceeds 30% by atom, the layer's resistance becomes too low and sufficient retention of charge cannot be secured. The transition metal element may be uniformly or nonuniformly distributed throughout the charge transporting layer and may be in the form of two-dimensional or three-dimensional aggregation.

Representative methods of formation of the photoreceptor will be described below.

Plasma CVD Method

In the formation of a electrophotographic photoreceptor by plasma CVD method, a gaseous organic metal raw material is introduced into a vacuum reactor, and a film is formed on a substrate placed on an electrode, while the temperature cf the electrode or substrate is in the range of 20–400° C. The film is formed by generating a discharge by applying an electric field, with frequency in the range of 0'5 GHz, between the electrodes. This step is performed under a constant pressure in the range of $10^{-4}-10^{-5}$ Torr. $AlCl_3$, $Al(CH_3)_3$ or $AL(C_2H_5)_3$ may be used as the raw material for aluminum, and $O_2$, $CO_2$, $N_2O$, $CH_4$, $C_2H_6$, $N_2$, $NH_3$ or NHNH may be used as the raw material of the reaction specieds for forming an aluminum oxide, carbide, or nitride, respectively.

As the raw material for a transition metal element, a gaseous organic metallic compound such as $CrF_3$, $CrF_4$, $ZrF_4$, $TiF_4$, $CuF_2$, NiF, $VF_5$, $MnF_2$, $MoF_6$, $MoCl_6$, $Wf_6$, $WCl_6$, $Zn(CH_3)_2$, $Zn(C_2H_5)_2$, $Zr(CH_3)_2$, or $Zr(C_2H_5)_2$ may be introduced into the vacuum reactor either as a mixture with a gas mentioned above or as a separate constituent. In so doing, gaseous hydrogen, nitrogen, helium, argon or the like may be used as a carrier gas.

Ion Plating Method

In the case of formation of a electrophotographic photoreceptor by ion plating, or the lie, aluminum and an oxide, carbide or nitride thereof may be used as the raw mateirals. The raw mateirals are placed within a vacuum chamber set at $10^{-5}$–$10^{-7}$ Torr, and are melted and evaporated by applying an electron gun at a voltage of 0.5–50 kV and a current of 1–1000 mA. Alternatively, the raw materials may be melted and evaporated by resistance heating, or the like by applying 1 to 500 volts to the ionization electrode and a bias voltage of 0 to −2000 V to the substrate. An aluminum oxide, carbide or nitride can be obtained by combining the above evaporated atoms and/or ions with atoms, ions or molecules of oxygen, carbon or nitrogen in the plasmas of $O_2$, $N_2$, $CO_2$, $CH_4$ and $NH_4$, and activating the mixture by glow discharge. The pressure at this time should be in the range of $10^{-6}$–$10^{-1}$ Torr, preferably in the range of $10^{-4}$–$10^{-2}$ Torr.

In order that the aluminum compound include a transition metal element, it is only necessary to evaporate a transition metal element, or its compound, by heating with an electron gun, or other method, from a separate evaporation source. Sc, Ti, V, Mn, Cr, Fe, Co, Ni, Cu, Zn, Zr, $TiO_2$, $ZrO_2$, $Fe_2O_3$, CoO, NiO, WC, TiC, CuO, ZrC, ScC, TiN, or the like, may be used as the raw material for the transition metal element.

Sol Gel Method

In the case of formation of a electrophotographic photoreceptor by sol-gel method, an aluminum alkoxide such as $Al(OCH_3)_3$, $Al(OC2H5)_3$, $Al(OC4H9)_3$, or the like, is dissolved in alcohol, and hydrolyzed while stirring. A sol solution generated by the reaction is applied to a substrate by either a spray or dipping process. After removal of the solvent, aluminum oxides can be obtained by heat drying at 50–300° C. for 1–24 hours.

Inclusion of a transition metal element may be accomplished by applying a solution to the substrate by a spray or dipping process in order to obtain a charge transporting layer with a desired thickness. This solution may be obtained by mixing an alkoxide compound such as $Ti(OC_3H_7)_4$, $Zr(OC_3H_7)_4$, $Y(OC_3H_7)_3$, $Y(OC_4H9)_3$, $Fe(OC_2H_5)_3$, $Fe(OC_3H_7)_3$, $Fe(OC_4H_9)_3$, $Nb(OCH_3)_5$, $Nb(OC_2H_5)_5$, $Nb(OC_3H_7)_5$, $Ta(OC_3H_7)$, $Ta(OC_4H_9)$, $V(OC_2H_5)_3$, or $V(OC_4H_9)_3$, or by mixing an organic metal complex such as iron tris(acetylacetonate), cobalt bis(acetylacetonate), nickel bis(acetylacetonate), or copper bis(acetylacetonate) into the above-mentioned solution.

Anode Oxidation Method

In the case of formation of a photoreceptor by anode oxidation method, an aluminum material for the substrate may be chosen from among various aluminum alloy materials including an Al-Mg system, Al-Mg-Si system, Al-Mg-Mn system, Al-Mn system, Al-Cu-Mg system, Al-Cu Ni system, Al-Cu system and Al-Si system. In addition, pure aluminum may be used. Although an anode oxidized film of aluminum can be formed by a known process, one can obtain a coating with the necessary thickness for a charge transporting layer by appropriately selecting from among various coating soluble electrolytes such as sulfuric acid, oxalic acid, chromic acid, phosphoric acid, sulfamic acid, and benzenesulfonic acid.

Either direct current or alternate current may be used for electrolysis. The concentration of the electrolytic solution should normally be 0.01–90% by weight in pure water in the case of a solid electrolyte, and 0.01–80% by volume in the case of a liquid electrolyte.

An anode oxidized film of aluminum can be formed by immersing an aluminum substrate for the electrophotographic photoreceptor as the anode, and a stainless steel plate or an aluminum plate as the cathode, with a spacing of 0.1–100 cm between the electrodes, and passing a current between them. A film formed in this manner consists of a nonporous base layer, with thickness proportional to the applied electrolytic voltage, and a porous layer formed thereon with thickness determined by the type of substrate used, electrolysis voltage, current density, temperature, and the like. The current density during anode oxidation should be 0.0001–10 $A/cm^2$, preferably 0.0005–1 $A/cm^2$. The electrolysis voltage should normally be 0–1000 V, preferably 0–700 V. In addition, the temperature of the electrolytic solution should be set to 0–100° C., preferably 10–95° C.

Inclusion of a transition metal element in the oxide film may be accomplished, for example, by depositing the metal element into the porous layer of the anode oxidized film by a known method of electrolysis. For example, one may carry out AC electrolysis by sulfuric or oxalic acid in an aqueous solution of a sulfate of Cu, Ni, Fe, Co, Cr, or the like. Depositing can also be achieved by dipping the specimen in a solution of ammonium oxalate or ammonium chromate.

An oxide, carbide or nitride of aluminum formed by a method illustrated above acts as a binding resin of distributed type charge transporting layer of organic low molecule. Similarly, the transition metal element acts as a low molecule which becomes the site of charge transportation.

The thickness of the charge transporting layer may be set appropriately. In the present invention it is in the range of 2–100 pm, preferably in the range of 3–50 μm.

As the charge generating layer of the electrophotographic photoreceptor, an inorganic substance such as amorphous silicon, selenium, selenium arsenide, or selenium telluride, formed by means of a method such as CVD, vapor deposition, or sputtering, may be used. Similarly, one may also use a thin film formed by dipping, or other method, of a material obtained by dispersing a photosensitive organic material, such as phthalocyanine, copper phthalocyanine, aluminum phthalocyanine, vanadium phthalocyanine, square phosphoric acid derivative, merocyanine, or bis-azo dye, into an evaporation or binding resin.

In the particular case of employing hydrogenated amorphous silicon as the charge generating layer, hydrogenated silicon doped with germanium or hydrogenated amorphous germanium, exhibits excellent mechanical and electrical characteristics.

A method of using hydrogenated amorphous silicon as the charge generating layer will now be described as an example.

A charge generating layer having amorphous silicon as the main constituent may be formed by a known method such as glow discharge decomposition, sputtering, ion plating, vacuum deposition, or the like. Such a film formation method can be selected appropriately with respect to the object, but the technique of decomposing silane or a silane-based gas by glow discharge by means of plasma CVD. By this method, a film having a relatively high resistance, high photosensitivity, and hydrogen content of 1-40% by atom is formed with preferable characteristics as a charge generating layer.

In the following, a plasma CVD method will be described as an example for forming the charge generating layer.

Silane, including silane and disilane, may be used as the gaseous raw material for manufacturing a charge generating layer having silicon as the main monstituent. Further, in forming a charge generating layer, hydrogen, helium, argon, neon, or the like, may be used as a carrier gas as need arises. It is also possible to mix an impurity such as boron or phosphorus into the film by combining a dopant gas such as diborane ($B_2H_6$) and phosphine ($PH_3$) into the raw material gas. Further, halogen atoms, carbon atoms, oxygen atoms, nitrogen atoms, or the like, may be included for the purpose of enhancing photosensitivity. Still further, elements such as germanium, tin, or the like, may be added for the purpose of enhancing sensitivity of the long wavelength region.

The amorphous silicone charge generating layer should have 1-40% by atom of hydrogen, preferably 5-20% by atom of hydrogen. The film thickness should be in the range of 0.1-30 μm, preferably 0.2-10 μm.

Formation of Additional Layers

During the manufacturing process of the electrophotographic photoreceptor according to the present invention, other layers may be formed above or below and adjacent to the charge generating layer and the charge transporting layer if needed. The following are examples of such layers.

A charge blocking layer, may be provided, for example, by an insulating layer of p-type or n-type semiconductor. This layer may be obtained by adding an element of group III or V of the periodic table to amorphous silicon, silicon oxide, silicon carbide, silicon nitride, amorphous carbon, or the like. In addition, a layer of p-type or n-type semiconductor obtained by adding a group III or V element to amorphous silicon, or a layer containing oxygen, carbon, or nitrogen may be used for the purpose of controlling the electrical and optical resolution characteristics of the electrophotographic photoreceptor or for enhancing its adhesivity. Although the thickness of these films is set in the range of 0.01-10 μm in the present invention, it may be determined arbitrarily.

A surface protective layer may also be provided for the purpose of preventing any change in quality of the surface of the photoreceptor by corona ions.

Each of the layers mentioned above may be formed by plasma CVD method. As described in the case of the charge generating layer, a gaseous body of a substance containing an impurity element may be introduced to the interior of a plasma CVD apparatus along with silane gas to carry out decomposition by glow discharge. The film formation conditions of each layer should be such that the frequency is normally in the range of 0'50 GHz, preferably 5-3 GHz, the pressure at the time of discharge is $10^{-5}$-5 Torr (0.001-665 Pa), and the substrate heating temperature of 100-400° C.

The present invention will be described by way of various examples.

Example 1

One gram of water and 1000 g of ethanol were stirred into a glass container having a stopper. Next, 10 g of $Al(OC_3H_7)_3$ were added to the mixture, stirred for 60 minutes, and electrolysis was performed. Following that, 1 g of $Zr(OC_4H_9)_4$ was added and stirred. The viscosity was regulated by concentrating the mixture, and the mixture was applied to a 2 mm thick aluminum plate by dipping. After drying by three steps of temperature from 100° C. to 300° C., a film 7 μm thick, consisting mainly of AlOx and including Zr, was formed. This plate was then placed in the vacuum chamber of a capacitance-coupled type plasma CVD apparatus.

While maintaining the substrate temperature at 250° C., and the vacuum chamber pressure at 0.5 torr, 100% silane ($SiH_4$) gas and hydrogen-diluted 100 ppm diborane ($B_2H_6$) gas were led into the reaction chamber at the rates of 100 cc/min and 2 cc/min, respectively. Then, glow discharge was performed at a frequency of 13.56 MHz, and a power of 100 W. This process resulted in a charge generating layer of 1 μm thick, which comprises an itype amorphous silicon layer having high dark resistance and containing hydrogen and a trace of boron. Subsequently, the reaction chamber was evacuated to a high vacuum, 30 sccm of $SiH_4$ and 30 sccm of $NH_3$ were introduced, and discharge was performed at 50 W. As a result, a SiNx film having thickness of 0.1 μm was formed to obtain an electrophotographic photoreceptor having a photosensitive layer of about 8 μm.

Determination of the electrophotographic characteristics of the electrophotographic photoreceptor thus obtained showed that it held a voltage of 310 V after charging with a corotron of +6 kV. The residual potential after exposure to 500 nm light was 10 V. Further, the photosensitivity was 6 erg/cm$^2$ ($E_{1/2}$).

EXAMPLE 2

A 99.99% pure aluminum substrate was fixed to a holder in the reaction chamber of a parallel plate plasma CVD reactor, and was heated at 300° C. after the reactor was evacuated to $10^{-6}$ Torr. Next, helium gas, used as a carrier gas, was passed, while bubbling through $Al(CH_3)_3$ held at 25° C., at a flow rate of 100 sccm. In addition, $Zr(CzH_2)_2$ at 20° C. was passed, using helium as the carrier gas, at a flow rate of 10 sccm.

Further, $N_20$ gas was introduced at a flow rate of 10 sccm from a separate introductory port. After setting the pressure at 0.5 Torr, discharge was started by applying 100 W of power at a frequency of 13.56 MHz. At that time, the temperature of the substrate was held at 350° C. Following discharge completion, the reactor was evaluated, and an a-Si:H layer and a SiNx surface layer were formed under the same conditions as in example 1. After taking the specimen out of the vacuum chamber, eddy currents were measured with a film thickness meter. The measurements showed that the thickness of the photosensitive layer was 8 μm. Accordingly, the thickness of the charge transporting layer, with AlOx as the main constituent and also containing Zr, was about 7 μm.

Determination of the electrophotographic characteristics of the electrophotographic photoreceptor thus obtained showed that it held of −300 V after charging with a corotron surface potential of −6 kV. The residual potential after exposure to 500 nm light was −15 V.

EXAMPLE 3

Using an arc discharge type ion plating apparatus having a resistance heater source and an electron beam heating means, 99.99% pure aluminum was placed in crucible for resistance heating while Ti was placed at the crucible center. After the vacuum chamber was evacuated to $10^{-4}$ Pa via an oil diffusion pump the Ti and Al were simultaneously evaporated with the use of a 3 KW electron gun and a resistance heater, respectively. At that time, theremoelectrons of about 1 mA were emitted by heating the thermoelectric filament. Ionization was carried out at an ionization electrode potential of 30 V.

By introducing $N_2$ has from below the thermoelectron emitter electrode, and setting the pressure to $6\times10^{-2}$ Pa, the $N_2$ was brought into reaction with the ionized Ti and Al to from a carge transporting layer 8 μm thick. This layer, containing Tl and consisting mainly of AlNx, was formed on a 1 mm thick stainless steel substrate biased at −500 V.

After taking the specimen out of the vacuum chamber it was placed in the parallel-plate type plasma CVD apparatus. After subsequent evacuation, a carge generating layer nd a surface layer were formed under the same conditions as in example 1.

Determination of the electrophtographic characteristics of the photoreceptor thus obtained showed that is held a voltage of 350 V after charging with a corotron of +6 kV. The sidual potential after exposure to 500 nm light was 15 V.

EXAMPLE 4

Using an ion plating evaporator as in example 3, a raw material obtained by mixing 5% by weight of powdery Cu to powdery $Al_2O_3$ was introduced to the crucible. After introducing gaseous oxygen and setting the pressure to $6\times10^{-2}$ Pa, ions were evaporated under the conditions of 2 kW for the electron gun, 10 mA of ionic current, and −200 V of substrate bias voltage, to form an AlOx fill of 10 μm thickness on an Al substrate held at 200° C.

After removing the specimen for the vacuum chamber it was placed in the parallel-plate type plasma CVD apparatus. After subsequent evacuation, a charge generating layer and a surface layer were formed under the same conditions as in example 1.

Determination of the electrophotographic characteristics of the electrophotographic photoreceptor thus obtained showed that it held a voltage of 450 V after charging with a corotron electrified of +6 kV. The residual potential after exposure to 500 nm light was 10 V.

EXAMPLE 5

Using an arc discharge type ion plating apparatus equipped with a resistance heater source nd an electron beam heating means, 99.99% pure Al was placed in a crucible for resistance heating while Ti was placed at the center crucible. After the vacuum chamber was evacuated to $10^{-4}$ Pa via an oil diffusion pump, Ti and Al were simultaneously evaporated with sue of a 3 kW electron gun and a resistance heater, respectively. At that time, the thermoelectron filament was heated to emit theremoelectrons of about 1 mA. Ionization was carried out with an ionization electrode potential of 50 V.

By introducing $C_2H_2$ from below the thermoelectron emitting electrode, and setting the pressure at $2\times10^{-2}$ Pa, the $C_2H_2$ was brought into reaction with the ionized Ti and Al to form a charge transporting layer 8.5 μm thick. this layer, containing Ti and consisting mainly of AlC, was formed on a 1 mm thick stainless tell substrate biased at −500 V.

After taking the specimen from the vacuum chamber, it was placed in the parallel-plate type palsma CVD apparatus. After subsequent evacuation, a charge engerating layer and a surface layer were formed under the same conditions as in example 1.

Determination of the electrophotographic characteristics of the electrophotographic photoreceptor thus obtained showed that it held a voltage of 400 V after charging with a crotron of +6 kV. The residual potential after exposure to 500 nm light was 5 V.

EXAMPLE 6

A cylindrical aluminum pipe, with diameter of about 120 mm and consisting of a 99.99% pure Al-mg alloy, was cleaned with Flon and distilled water via ultrasonic waves. It was then subjected to a 15 minute boiling treatment in pure water. Subsequently, using a 5% oxalic acid solution held at a temperature of 30° C., a DC voltage of 10 V was applied between the aluminum pipe and a stainless steel plate, serving as a cylindrical cathode, to carry out anode oxidation of 60 minutes. The aluminum oxide coating obtained had a thickness of 15 μm.

Next, electrolysis was performed at a temperature of 20° C. and a voltage of 15 V for 20 minutes in an aqueous solution containing 3% of $CuSO_4{\cdot}5H_2O$ and 1% of $H_2SO_4$. the color of the specimen turned to brown, showing deposition of Cu i the porous region.

After cleaning the aluminum pipe in distilled water via ultrasonic waves, and drying at 100° C., it was placed in the vacuum chamber of a capacitance-coupled type plasma CVD apparats. Next, a charge generating layer and a surface layer were formed under the same conditions as in example 1.

Determination of the electrophotographic characteristics of the electrophotographic photoreceptor thus obtained showed that it held a voltage of 450 V after charging with a corotron of +6 kV. The residual potential after exposure to 500 nm light was 20 V.

As described above, the charge transporting layer used in the photoreceptor according to his invention comprises an oxide, carbide of nitride of aluminum, or the mixture of two or more of them, and contains a transition metal element, so that it has high adhesivity, high mechanical strength, hardness and less defects. Further, the electrophotographic photoreceptor having the charge transporting layer shows effects that it has high durability, high sensitivity and enhanced panchromaticity, high charge acceptance and low dark decay, and moreover, that its residual potential after exposure is low. Still further, the electrophotographic photoreceptor of the present invention is applicable to a device which uses a light source of coherent light such as an infrared semiconductor laser, and makes it possible to obtain a picture of high picture quality and prevent the generation of interference fringes in a laser printer.

What is claimed is:

1. An electrophtographic photoreceptor comprising:

a substrate;

an electrical charge generating layer; and an electrical charge transporting layer, wherein said electrical charge transporting layer comprises at least one material selected for the group consisting of aluminum oxide, aluminum carbide, and aluminum nitride, said selected material being combined with a transition metal element, said transition metal element being present in a range of 0.01–30 atomic percent;

wherein when said electrical charge transporting layer comprises aluminum oxide, said charge transporting layer comprises oxygen and aluminum, said oxygen having an atomic a ratio of at least 0.1 with respect to said aluminum; wherein when said electrical charge transporting layer comprises aluminum nitride, said charge transporting layer comprises nitrogen and aluminum, said nitrogen having an atomic ratio of at least 0.1 with respect to said aluminum; and wherein said said electrical charge transporting layer comprises aluminum carbide, said charge transporting layer comprises carbon and aluminum, said carbon having an atomic ratio of at least 0.05 with respect to said aluminum.

2. The photoreceptor according to claim 1, wherein aid electrical charge generating layer has a substrate side and a side opposite said substrate, and wherein said charge transporting layer is placed on said substrate side with respect to said charge generating layer.

3. The photoreceptor according to claim 1, wherein said electrical charge generating layer has a substrate side and a side opposite said substrate, and wherein said charge transporting layer is placed on said side opposite said substrate with respect to said charge generating layer.

4. The photoreceptor according to claim 1, wherein aid charge transporting layer contains oxygen and aluminum.

5. The photoreceptor according to claim 4, wherein the atomic ratio of aid oxygen to said aluminum is in the rane of 0.1–1.5.

6. The photoreceptor according to claim 1, wherein said charge transporting layer contains carbon and aluminum.

7. The photoreceptor according to claim 6, wherein the ratio of said carbon to said aluminum is in the range of 0.05–0.7.

8. The photoreceptor according to claim 1, wherein said transition metal element is selected from eh group consisting of 3d, 4d, and 5d transition elements.

9. The photoreceptor according to claim 8, wherein said transition metal element is Sc, Ti, V, Cr, Mn, Fe, Co, Ni, or Cu.

10. The photoreceptor according to claim 1, wherein said transition metal element is in the form of two-dimensional or three-dimensional aggregation.

11. The photoreceptor according to claim 1, said photoreceptor further comprising an intermediate layer selected from a charge blocking layer, a surface protective layer, and a combination of said layers.

12. The photoreceptor according tot claim 1, wherein said electrical charge generating layer contains 1–40% by atom of silicon and 5–20% by atom of hydrogen.

13. The photoreceptor according to claim 1, wherein said electrical charge generating layer is 0.1–30 μm thick.

14. The photoreceptor according to claim 1, wherein said electrical charge generating layer is made of material selected for the group consisting of amorphous silicon, selenium, selenium arsenide, and selenium telluride, and wherein said electrical harge generating layer is formed by CVD, vapor deposition, or sputtering.

15. The photoreceptor according to claim 14, wherein said amorphous silicon is hydrogenated amorphous silicon or hydrogenated amorphous silicon doped with germanium.

16. The photoreceptor according to claim 4, wherein the atomic ratio of said oxygen to said aluminum is in the range of 0.1–2.0.

17. The photoreceptor according to claim 16, wherein the atomic ratio of said oxygen to said aluminum is in the range of 0.2–1.5.

18. The photoreceptor according to claim 7, wherein the atomic ratio of said carbon to said aluminum is in the range of 0.2–0.7.

19. The photoreceptor according to claim 1, wherein the content of said transition metal element in said charge transporting layer is in the range of 1–20 atomic percent.

* * * * *

UNITED STATES PATENT AND TRADEMARK OFFICE

CERTIFICATE OF CORRECTION

PATENT NO. : 5,041,350

DATED : August 20, 1991

INVENTOR(S) : Shigeru Yagi

It is certified that error appears in the above-identified patent and that said Letters Patent is hereby corrected as shown below:

Claim 1, column 10, line 66, change "electrophtographic" to --electrophotographic--.

Claim 1, column 11, line 3, change "for" to --from--.

Claim 1, column 11, line 13, after "atomic" delete --a--.

Claim 1, column 11, line 20, after "wherein" inert --when--.

Claim 1, column 11, line 20, delete "said" (first occurrence).

Claim 2, column 11, line 26, change "aid" to --said--.

Claim 4, column 11, line 38, change "aid" to --said--.

Claim 5, column 11, line 42, change "aid" to --said--.

UNITED STATES PATENT AND TRADEMARK OFFICE

CERTIFICATE OF CORRECTION

PATENT NO. : 5,041,350

DATED : August 20, 1991

INVENTOR(S) : Shigeru Yagi

It is certified that error appears in the above-identified patent and that said Letters Patent is hereby corrected as shown below:

Claim 5, column 11, line 43, change "rane" to --range--.

Claim 8, column 12, line 5, change "eh" to --the--.

Claim 12, column 12, line 17, change "tot" to --to--.

Claim 14, column 12, line 25, change "for" to --from--.

Claim 14, column 12, line 27, change "harge" to --charge--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*